US006604607B2

(12) United States Patent
Walden

(10) Patent No.: US 6,604,607 B2
(45) Date of Patent: Aug. 12, 2003

(54) EXTENDABLE A-FRAME LADDER FOR UNEVEN SURFACES

(76) Inventor: John B. Walden, 8926 Courtney La., Highlands, TX (US) 77562

( * ) Notice: Subject to any disclaimer, the term of this patent is extended or adjusted under 35 U.S.C. 154(b) by 0 days.

(21) Appl. No.: 09/978,285

(22) Filed: Oct. 17, 2001

(65) Prior Publication Data

US 2002/0053488 A1 May 9, 2002

Related U.S. Application Data

(60) Provisional application No. 60/246,505, filed on Nov. 7, 2000.

(51) Int. Cl.[7] ..... E06C 1/00

(52) U.S. Cl. ..... 182/201; 182/209

(58) Field of Search ..... 182/200, 201, 182/209, 202, 203, 204, 205, 184, 225, 166, 207–212; 248/188.1–188.4, 157, 161, 354

(56) References Cited

U.S. PATENT DOCUMENTS

| | | | | | |
|---|---|---|---|---|---|
| 2,223,911 | A | * | 12/1940 | Garnette | 182/204 X |
| 3,374,860 | A | * | 3/1968 | Stewart | 182/204 X |
| 5,000,289 | A | * | 3/1991 | Sanchez, III | 182/209 X |
| 5,027,923 | A | * | 7/1991 | Derome | 182/201 |
| 5,908,085 | A | * | 6/1999 | Lovelady | 182/204 |

* cited by examiner

*Primary Examiner*—Daniel P. Stodola
*Assistant Examiner*—Hugh B. Thompson
(74) *Attorney, Agent, or Firm*—Randal D. Homburg

(57) ABSTRACT

An A-frame ladder able to be on uneven surfaces, stairs or level surfaces in a stable and level configuration, includes a sliding ladder segment attached to the A-frame ladder segments, locking bars on the sliding ladder segments spaced apart along the sliding ladder segments, sliding bracket mounts attaching each sliding ladder segment to the A-frame ladder segments, and pivoting spring-loaded locking catches securing the sliding ladder segment to the A-frame ladder segments.

1 Claim, 2 Drawing Sheets

EXTENDABLE A-FRAME LADDER FOR UNEVEN SURFACES

CROSS REFERENCE TO RELATED APPLICATIONS

Provisional Patent Application No. 60/246,505, filed on Nov. 7, 2000.

BACKGROUND OF INVENTION

1. Field of the Invention

The invention is an improvement to an A-frame ladder, adding to an A-frame ladder independent extension means allowing the ladder to be placed on uneven surfaces, stairs or level surfaces in a stable and level configuration.

2. Description of Prior Art

The following United States patents are identified and disclosed herein. Several devices are disclosed relating to ladders having extending characteristics. In U.S. Pat. No. 4,299,306 to C Hawkins, and U.S. Pat. No. 5,429,207 to Frank, a secure catch is disclosed for extension ladders. In U.S. Pat. No. 5,273,133 to Thocher, an extension for each leg of a ladder is disclosed allowing the ladder to be placed on uneven surfaces, the means of extension using a locking gear and a drive rod. U.S. Pat. No. 5,542,497 to Macyszyn discloses a similar extension mechanism as in Thocher, but a cam self-locking mechanism is used to lock the legs into position. A similar A-frame extension ladder is disclosed in U.S. Pat. No. 4,926,964 to Herrin, but it does not include a pivoting spring loaded locking catch for a plurality of locking bars on the sliding ladder segments and the A-frame ladder segments.

More recently, in U.S. Pat. No. 6,073,726 to McCrystal, an adjustable step ladder is disclosed having four independent extendable legs locking with pins riding in a slot of the adjustable legs. In U.S. Pat. No. 6,237,718 to Schwarzel, an extendable legs means for a leveling a ladder is disclosed, the means including a cable and pulley style leveling system and a built in level indicator. An adjustable ladder having a screw type leg lock is disclosed in U.S. Pat. No. 6,234,273 to Moore.

SUMMARY OF THE INVENTION

The invention is an improvement to an A-frame ladder, the improvement providing additional sliding ladder segments to the A-frame ladder allowing these sliding ladder segments to independently extend the A-frame ladder segments allowing the ladder to be placed on stairs, uneven surfaces or level ground, the sliding ladder segments and the A-frame ladder segments to be slidably engaged and locked by pivoting spring-loaded locking catches engaging a plurality of locking bars on the inside portion of the sliding ladder segments and the A-frame ladder segments, away from the area of travel by the person using the ladder.

DESCRIPTION OF THE DRAWINGS

The following drawings are informal drawings submitted with this provisional patent application.

DESCRIPTION OF THE PREFERRED EMBODIMENT

Figure 1:
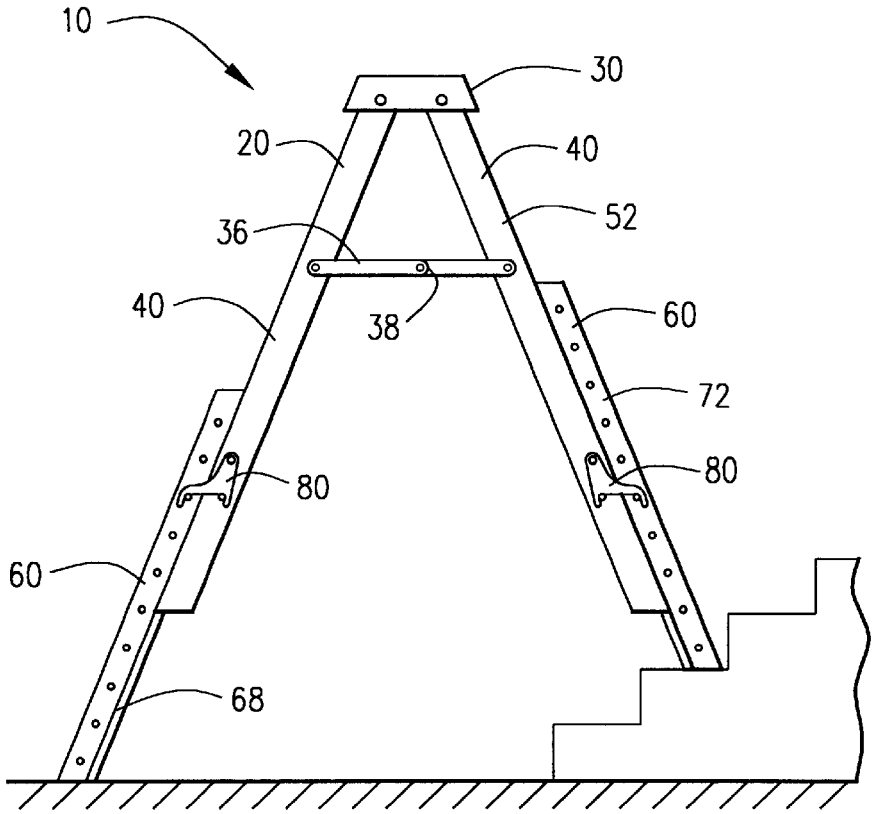
FIG. 1 is an inside side view of the invention on stairs.

The invention, as shown in FIGS. 1–4, is an improvement to an A-frame ladder 20, the improvement comprising a sliding ladder segment 60 attached to A-frame ladder segments 40 included on the A-frame ladder 20, a plurality of locking bars 66 on the sliding ladder segments 60 spaced apart along each sliding ladder segment 60, sliding bracket mounts 48 attaching each sliding ladder segment 60 to each A-frame ladder segments 40, and pivoting spring-loaded locking catches 80 securing the each sliding ladder segment 60 to each A-frame ladder segment 40.

Figure 4:
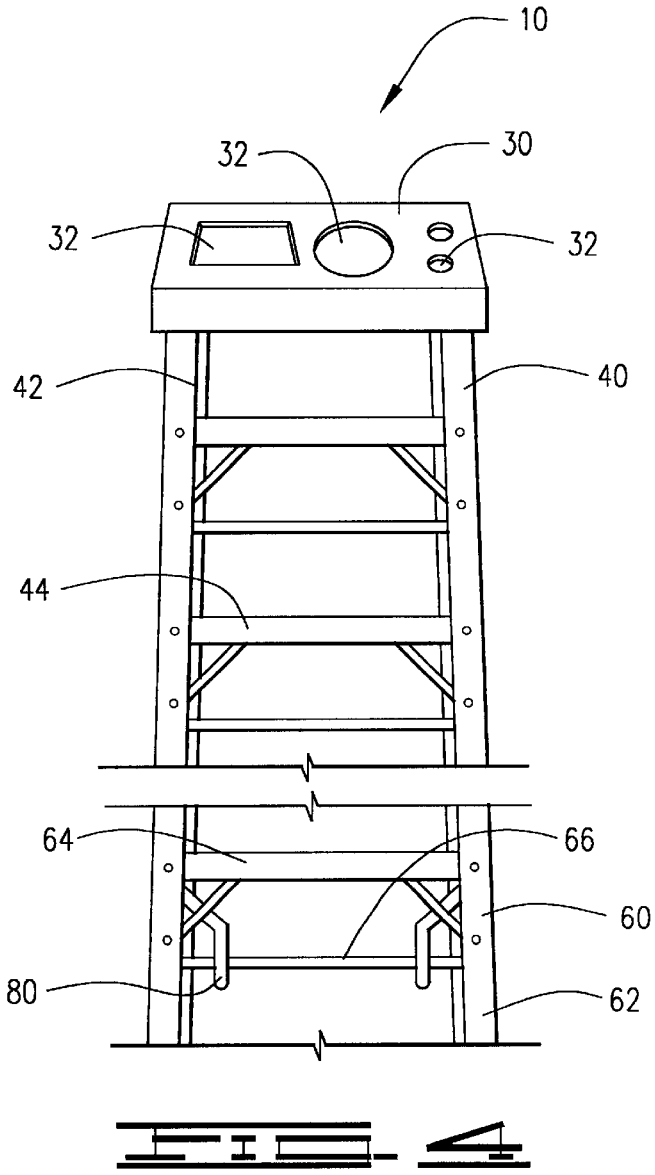
FIG. 4 is a front view of the invention.

The A-frame ladder 20, as shown in FIG. 4 of the drawings, has a top plate 30, which in a preferred embodiment may have a plurality of slots, trays and grooves 32 to allow for the insertion of tools, screws, nuts and bolts. The A-frame ladder 20 has two A-frame ladder segments 40 pivotally attached to the top plate 30. Between the two A-frame ladder segments 40 is a pivotally attached securing bar 36 preventing separation of the two A-frame ladder segments 40 past a certain angle. The pivotally attached securing bar 36 allows the two A-frame ladder segments 40 to be stored flat against each other. The securing bar 36 has a locking means 38 to prevent disengagement during use. Each A-frame ladder segment 40 has two side rails 42 with a plurality of spaced rungs 44 which are configured in a flat plane for standing.

Figure 2:
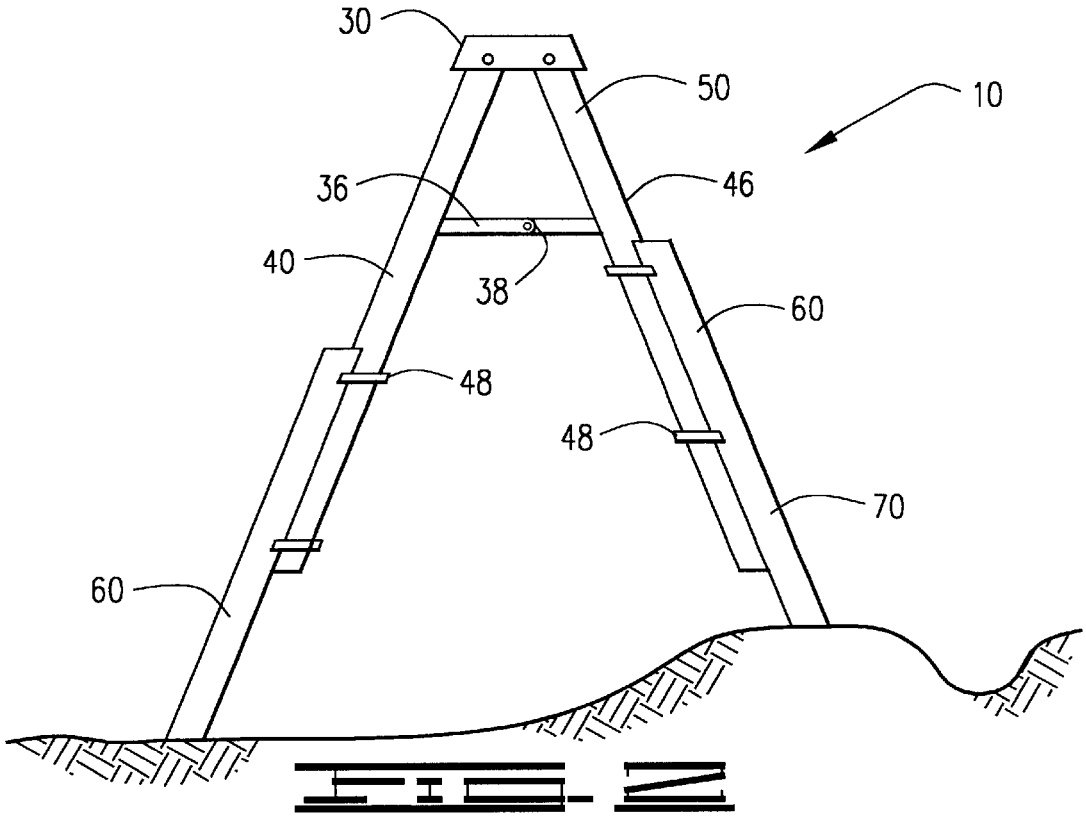
FIG. 2 an outside view of the side of the invention on an uneven surface.

Each sliding ladder segment 60 is slidably engaged with each A-frame ladder segment 40 by sliding bracket mounts 48, as shown in FIG. 2 of the drawings, affixed to each sliding ladder segment 60. Each sliding ladder segment 60 has two side rails 62 with a plurality of spaced rungs 64 which are also configured in a flat plane connecting the two side rails 62, and also includes a plurality of locking bars 66 extending between the two side rails 62. In a preferred embodiment, the two side rails 62 may include a channel locking means 68 engaging a channel ridge 46 included on the side rails 42 of the A-frame ladder segments 40. The side rails 42 of the sliding ladder segment 60 include an outside surface 70 and an inside surface 72, the inside surface 72 to which the plurality of locking bars 66 and spaced rungs 64 are attached. The side rails 42 of the A-frame ladder segment 40 also include an inside surface 52 and an outside surface 50.

Figure 3:
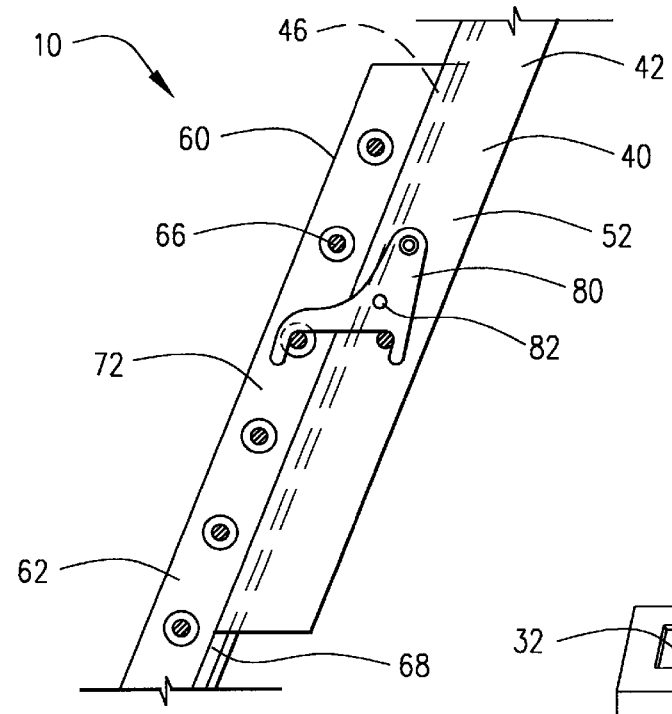
FIG. 3 is a side view of the pivoting spring loaded locking catch engaging a locking bar on the sliding ladder segments and the A-frame ladder segments.

The inside surface 52 of each side rail 42 of the A-frame ladder segment 40 includes the pivoting spring-loaded locking catch 80. This pivoting spring-loaded locking catch 80 engages the locking bars 66 of the sliding ladder segment 60, retaining the sliding ladder segment 60 in a fixed position to the A-frame ladder segment 40, as shown in FIG. 3 of the drawings. In a preferred embodiment, this pivoting spring-loaded locking catch 80 also has a locking means 82 to prevent incidental disengagement of the pivoting spring-loaded locking catch 80 from the locking bar 66 while the invention 10 is in use.

Each sliding ladder segment 60 is independent from the other sliding ladder segment 60, allowing for the sliding ladder segments 60 to be positioned on different levels or on the same level, as shown in FIGS. 1 and 2. This enables the user to position the invention 10 for use on a flight of stairs, on uneven terrain, on a hill, or on a level surface. The invention 10 may be used as an A-frame ladder or as an extension ladder to be propped against a wall.

Although the embodiments of the invention have been described and shown above, it will be appreciated by those skilled in the art that numerous modifications may be made therein without departing from the scope of the invention as herein described.

I claim:

1. An improvement to an A-frame ladder having a top plate with a plurality of slots, trays and grooves, two A-frame ladder segments, having an inside surface and an outside surface, including two side rails and a first plurality of spaced rungs configured in a flat plane for standing, the A-frame ladder segments attached to the top plate, a pivotally attached securing bar preventing separation of the two A-frame segments past a certain angle, having a locking means to prevent disengagement of the securing bar during use, the improvement comprising:

sliding ladder segments, having an outside surface and an inside surface, slidably engaging the outside surface of each of the A-frame ladder segments by sliding bracket mounts affixed to each of sliding ladder segments each of the sliding ladder segments having two side rails with a second plurality of spaced rungs configured in a flat plane connecting the two side rails of the sliding ladder segments;

a channel locking means included in the two side rails, of the sliding ladder segments, which engages channel ridge included in the side rails of the A-frame ladder segments;

a plurality of locking bars and the second plurality of spaced rungs on the inside surface of the sliding ladder segments; and pivoting spring-loaded locking catches on the inside surface of each of the side rails of the A-frame ladder segments engaging the locking bars of the sliding ladder segments, retaining the sliding ladder segments in a fixed position with the A-frame ladder segments, wherein each of sliding ladder segments is independent from the other sliding ladder segment, allowing the sliding ladder segments to be positioned on different levels or on the same level and wherein each of the pivoting spring-loaded locking catches has a locking means to prevent incidental disengagement of the pivoting spring-loaded locking catches from the locking bar while the ladder is in use.

* * * * *